US010820683B1

(12) United States Patent
Tran et al.

(10) Patent No.: US 10,820,683 B1
(45) Date of Patent: Nov. 3, 2020

(54) HOLSTER WITH ATTACHMENT INTERFACE

(71) Applicant: MOTOROLA SOLUTIONS, INC., Chicago, IL (US)

(72) Inventors: Chi T. Tran, Naperville, IL (US); Ryan M Nilsen, Plantation, IL (US); Goktug Duman, Oakland Park, FL (US); Kiok Yung Lee, Nibong Tebal (MY)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 0 days.

(21) Appl. No.: 16/526,483

(22) Filed: Jul. 30, 2019

(51) Int. Cl.
*A45F 5/02* (2006.01)

(52) U.S. Cl.
CPC ..... *A45F 5/021* (2013.01); *A45F 2200/0516* (2013.01)

(58) Field of Classification Search
CPC ..... A45F 5/021; A45F 2200/0516; A45F 2200/0591; A45F 2200/0508; A45F 2005/026; F41C 33/041; F41C 33/048; F41C 33/0209; F41C 33/006
USPC ..... 224/666–668
See application file for complete search history.

(56) References Cited

U.S. PATENT DOCUMENTS 2,693,654 A 11/1954 Clark
5,125,134 A 6/1992 Morita
5,283,966 A 2/1994 Rader et al.
5,641,102 A * 6/1997 Hellweg ..... A45F 5/00 224/198
5,748,454 A * 5/1998 Nichols ..... A45F 5/02 24/3.11
5,829,102 A * 11/1998 Conti ..... G08B 3/1058 24/3.12
6,064,577 A * 5/2000 Moskowitz ..... H04B 1/385 206/340
6,082,688 A * 7/2000 Wilson ..... A01K 97/10 248/222.11
6,105,182 A * 8/2000 Elnar ..... A61H 7/00 248/125.3
6,405,910 B1 * 6/2002 Infanti ..... A45F 5/02 224/269
7,120,972 B2 10/2006 O'Banion
7,140,047 B2 11/2006 Kronenberger
7,267,479 B2 9/2007 Terentiev
7,360,334 B2 4/2008 Christiansen
7,445,246 B1 * 11/2008 Wagschal ..... B42F 9/001 24/67 R
7,922,050 B2 * 4/2011 Beneš ..... F41C 33/0227 224/244

(Continued)

OTHER PUBLICATIONS

SP Gadgets, "Flex Mount", http://www.sp-gadgets.com/en/actioncam-accessories/flex-mount-2, retrieved from the internet: Jun. 20, 2018, all pages.

(Continued)

*Primary Examiner* — Adam J Waggenspack
(74) *Attorney, Agent, or Firm* — Barbara R. Doutre

(57) ABSTRACT

A holster is provided with an improved attachment interface. The attachment interface is integrated as part of the holster housing and provides a railed track within a circular retaining wall. The attachment interface interchangeably accommodates a variety of different accessory attachments and mounting configurations.

13 Claims, 9 Drawing Sheets

(56) References Cited

U.S. PATENT DOCUMENTS

| | | | | |
|---|---|---|---|---|
| 8,317,067 | B2 | 11/2012 | Lewis | |
| 8,615,853 | B2 | 12/2013 | Rathbun | |
| 8,616,422 | B2 | 12/2013 | Adelman et al. | |
| 9,380,258 | B2 | 6/2016 | Sandy | |
| D762,942 | S | 8/2016 | Patulski | |
| 9,851,178 | B2 | 12/2017 | Cosso | |
| 10,634,452 | B1 * | 4/2020 | Chester | F41C 33/0263 |
| 2005/0167485 | A1 | 8/2005 | Taras | |
| 2006/0022822 | A1 | 2/2006 | Wong et al. | |
| 2006/0032877 | A1 | 2/2006 | Obolo | |
| 2006/0054647 | A1 | 3/2006 | Kathrein et al. | |
| 2006/0237495 | A1 | 10/2006 | Chen et al. | |
| 2008/0023508 | A1 | 1/2008 | Harchol | |
| 2016/0028947 | A1 | 1/2016 | Wexler et al. | |
| 2017/0105510 | A1 | 4/2017 | Tran et al. | |
| 2017/0122701 | A1 | 5/2017 | Lim et al. | |
| 2018/0109765 | A1 | 4/2018 | Wu | |
| 2018/0364018 | A1 * | 12/2018 | McCulley | F42B 39/02 |

OTHER PUBLICATIONS

Tran, Chi T. et al.: "Magnet Mount Apparatus for a Portable Communication Device", U.S. Appl. No. 16/043,502, filed Jul. 24, 2018, all pages.

* cited by examiner

HOLSTER WITH ATTACHMENT INTERFACE

FIELD OF DISCLOSURE

The present disclosure relates generally to holsters for electronic devices and more particularly to an attachment interface for a body worn holster.

BACKGROUND OF THE INVENTION

Police officers, security companies, emergency rescue personnel, and other public safety personnel often utilize a variety of portable electronic devices, such as portable radios, remote speaker microphones, and the like. Such devices are often worn on the body using a variety of different body wearable mounting mechanisms. The different mounting mechanisms must accommodate the device as well as the intended article of clothing worn by the user, thereby resulting in numerous attachment mechanisms. There is a desire to simplify the manner in which portable devices are worn on the body. Stability and secure attachment to an article of clothing are very important considerations.

Accordingly, there is a need for an improved attachment interface.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
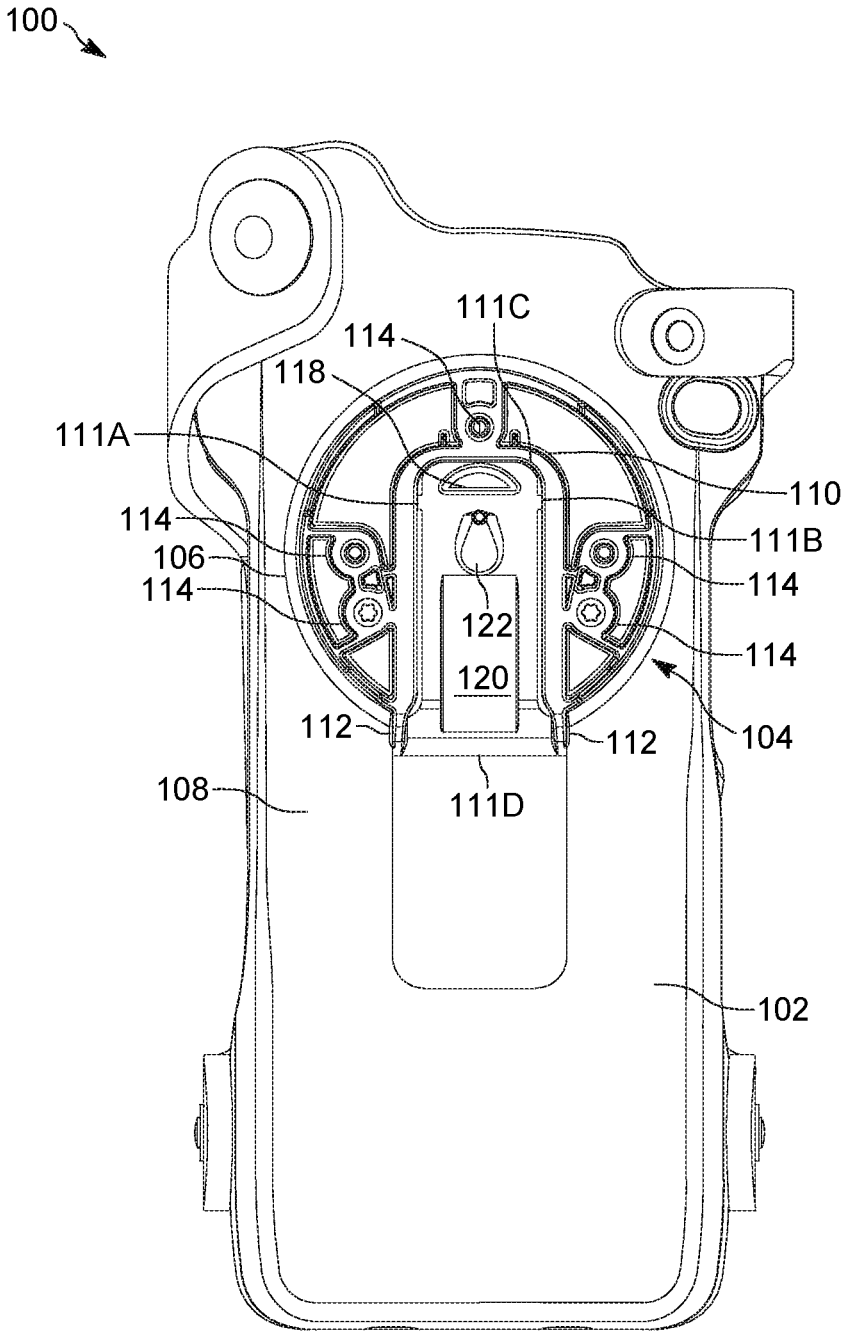
FIG. 1 is a back view of a holster with attachment interface in accordance some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

Briefly, there is provided herein an improved attachment interface. The attachment interface is particularly well suited for integration as part of a holster, such as a holster used in public safety applications. The attachment interface accommodates a variety of mounting accessories thereby facilitating a plurality of body wearable options.

FIG. 1 is a back view of a holster 100 formed in accordance with some embodiments. The holster 100 comprises a housing 102 for receiving a portable communication device such as a portable radio or remote speaker microphone (not shown). In accordance with some embodiments, the holster 100 comprises an attachment interface 104, the attachment interface providing a form factor which interchangeably accommodates a plurality of different mounting accessories, such as circular disk mountable accessories and linear mountable accessories, such as clip mountable accessories, for improved body wearability and secured retention of the holster upon a user's body.

In accordance with some embodiments, the attachment interface 104 comprises a circular retaining wall 106 integrally formed on and extending from an exterior surface 108 of the housing 102. A relief opening 112 is formed along a portion of the circular retaining wall 106. The relief opening 112 also provides access to an open end of a railed track 110 which, in accordance with some of the embodiments, is formed within the circular retaining wall 106. The railed track 110 is of sufficient size to accommodate a clip, such as a belt clip or other linearly insertable mountable accessory.

The railed track 110 is integrally formed within the circular retaining wall 106, as part of the exterior housing surface, the railed track having first and second linear side walls 111*a*, 111*b*, a closed end wall 111*c*, and open end 111*d*. The open end 111*d* of the railed track 110 is aligned and merges with the relief opening 112 of the circular retaining wall 106.

The open end 111*d* of the railed track 110 being aligned and merged with the relief opening 112 of the circular retaining wall 106 advantageously allows for slide-in linear-mountable accessories, such as dip mountable accessories to be attached to the holster interface 104. The railed track 110 may further comprise a ramp 120 and locking pin 122 formed therein for capturing a clip, and a release insert 118 for accommodating a screwdriver tip to remove a previously inserted clip. The railed track 110 thus advantageously provides a platform for slide-in clip type attachments. The circular retaining wall 106 advantageously provides a platform for circular disk-mountable attachments. The circular retaining wall 106 is formed of a plurality of perimeter alignment ribs having a plurality of relief zones formed therebetween (which are more clearly seen in FIG. 2), one of which is the relief zone 112.

The attachment interface 104 may further comprise a plurality of screw mounts 114 integrally formed and located between interior portions of the circular retaining wall 106 and the railed track 110. One or more of the screw mounts can be utilized as an additional attachment interface, either alone or in combination with the railed track 110 and/or the circular retaining wall 106.

Figure 2:
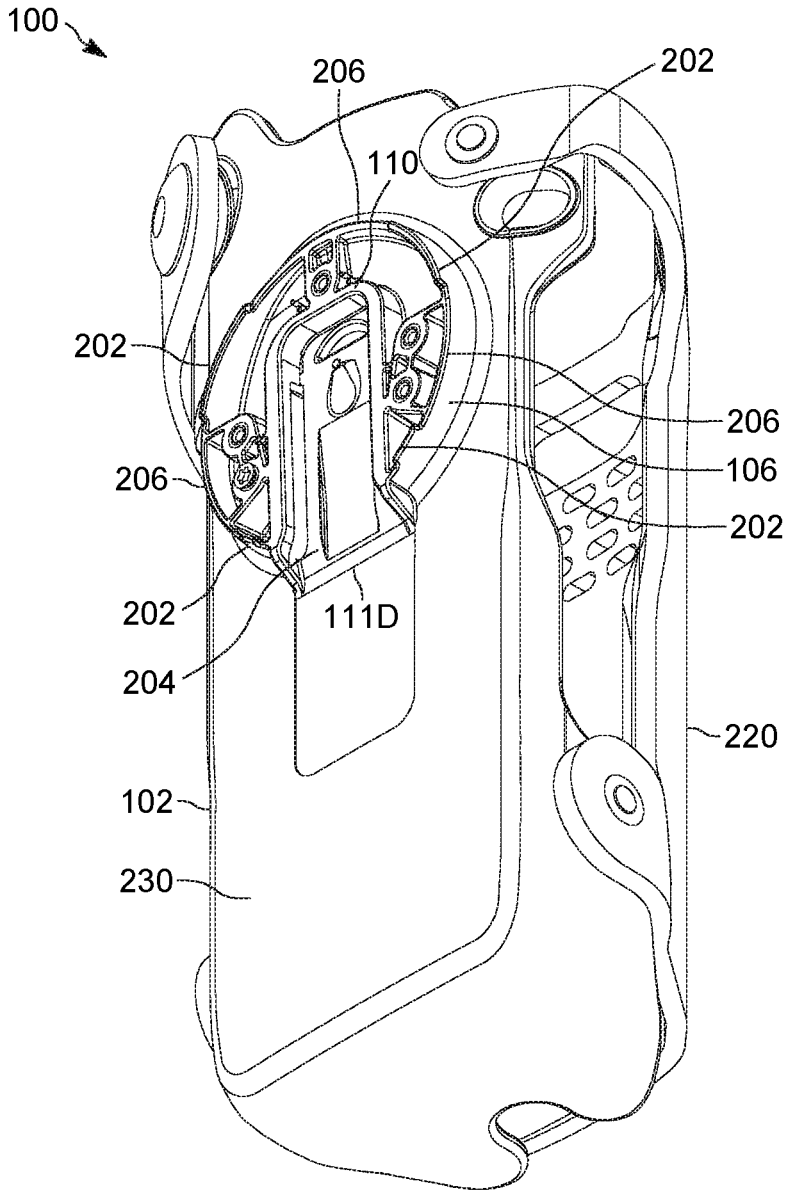
FIG. 2 is an isometric view of the holster with attachment interface in accordance with some embodiments.

Referring now to FIG. 2, there is shown an isometric view of the holster 100 in accordance with some embodiments. The housing 102 may be formed of a front, non-rigid housing portion 220 and a back, rigid housing portion 230, wherein the attachment interference is integrally formed as part of the back, rigid housing portion. The back rigid, housing portion 230 is formed of a substrate, such as a molded plastic. The molded plastic is sufficiently hard to provide robust rigidity to the holster 100 as well as to the attachment interface 104 integrally molded as part of the back rigid, housing portion 230.

The isometric view of FIG. 2 more clearly shows the circular retaining wall 106. The circular retaining wall 106 is formed of a plurality of perimeter alignment ribs 202 having a plurality of relief zones 206 formed therebetween, one of which is the relief zone 112 of FIG. 1, which in this view will now be referred to as primary relief zone 204, while the remaining of the plurality of relief zones will be referred to as secondary relief zones 206. Hence, the open end 111*d* of the railed track 110 is aligned and merges with the primary relief zone 204 of the circular retaining wall 106.

While the plurality of screw mounts 114 may be disposed in different locations between the circular retaining wall 106 and the railed track 110, the placement shown in FIGS. 1 and 2 advantageously places the screw mounts between the secondary relief zones 206 of retaining wall 106 and the side walls 111*a*, 111*b* and closed end wall 111*c* of the railed track 110. This configuration advantageously allows for attachments (linear or circular) to be mounted to the interface 104 without interfering with the railed track 110.

Accordingly, the holster 100 with attachment interface 104 integrated formed thereon, provides a plurality of integrated platforms upon which accessory mountings may be interchangeably attached and removed. The railed tracks 110 provide a first attachment interface, the circular retaining wall 106 provides a second attachment interface, the one or more screw mounts 114 provide a third attachment interface, the railed track 110 and at least one screw mount in combination provide a fourth attachment interface, and the circular retaining wall 106 and at least one screw mount in combination provide a fifth attachment interface. Hence, the attachment interface 104 having circular retaining wall 106 and railed track 110 formed therein enables retention of non-screw mount linear and circular plate accessory mounts, screw-mount linear and circular plate accessory mounts, and/or a combination thereof. For example, a linear clip can be mounted and snapped into the locking pin of alignment rails 110, with or without the use of a screw. The use of a screw at the top end of a clip can provide additional robustness. Circular plate mounts can be inserted within the alignment ribs 202 and rotated for retention therein, with or without the screws. The use of the screw the mounts 114 can be used to provide additional robustness to the mounting.

Figure 3A:
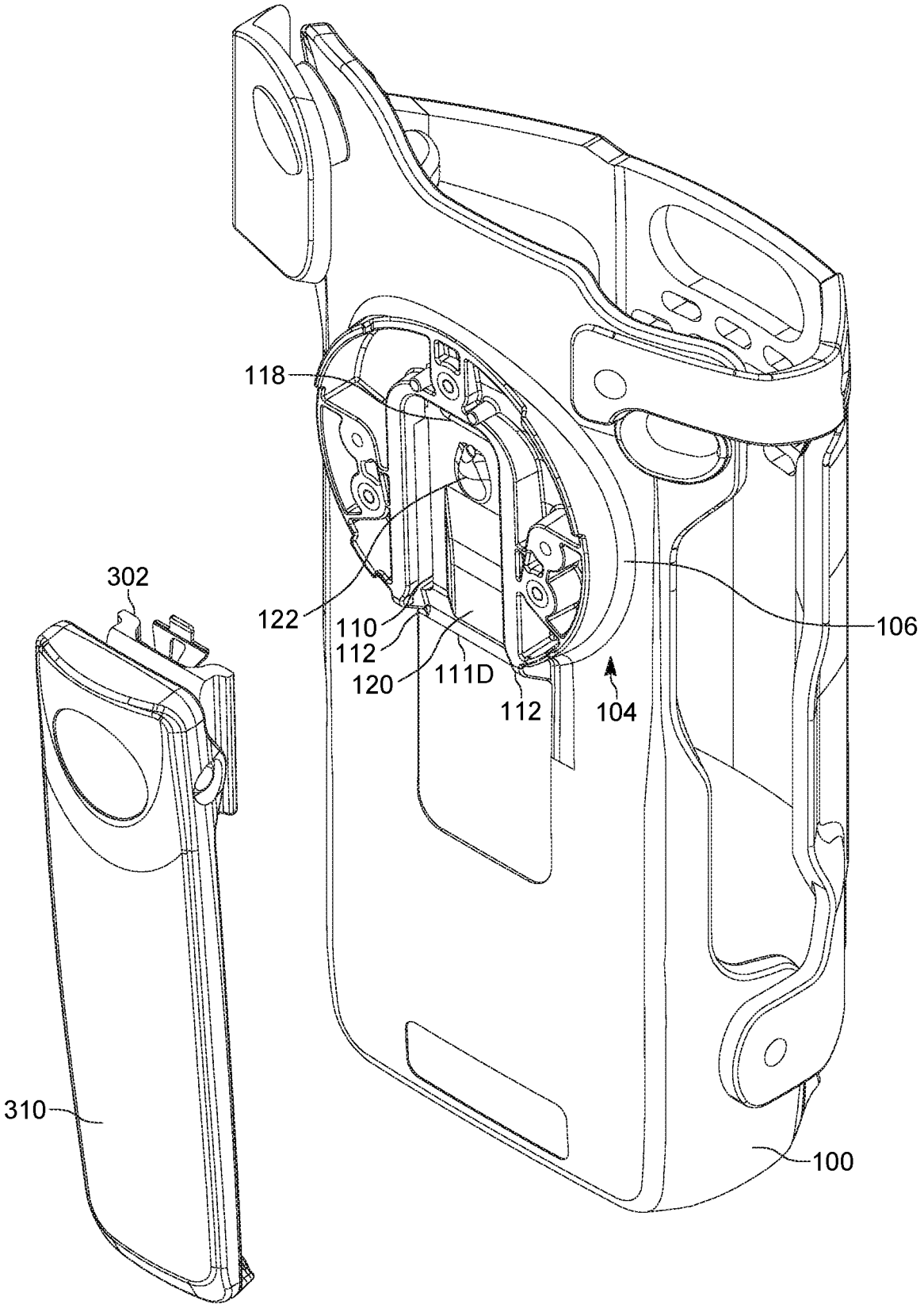
FIG. 3A shows the attachment terface of the holster with a first mountable accessory in accordance with some embodiments.
Figure 3B:
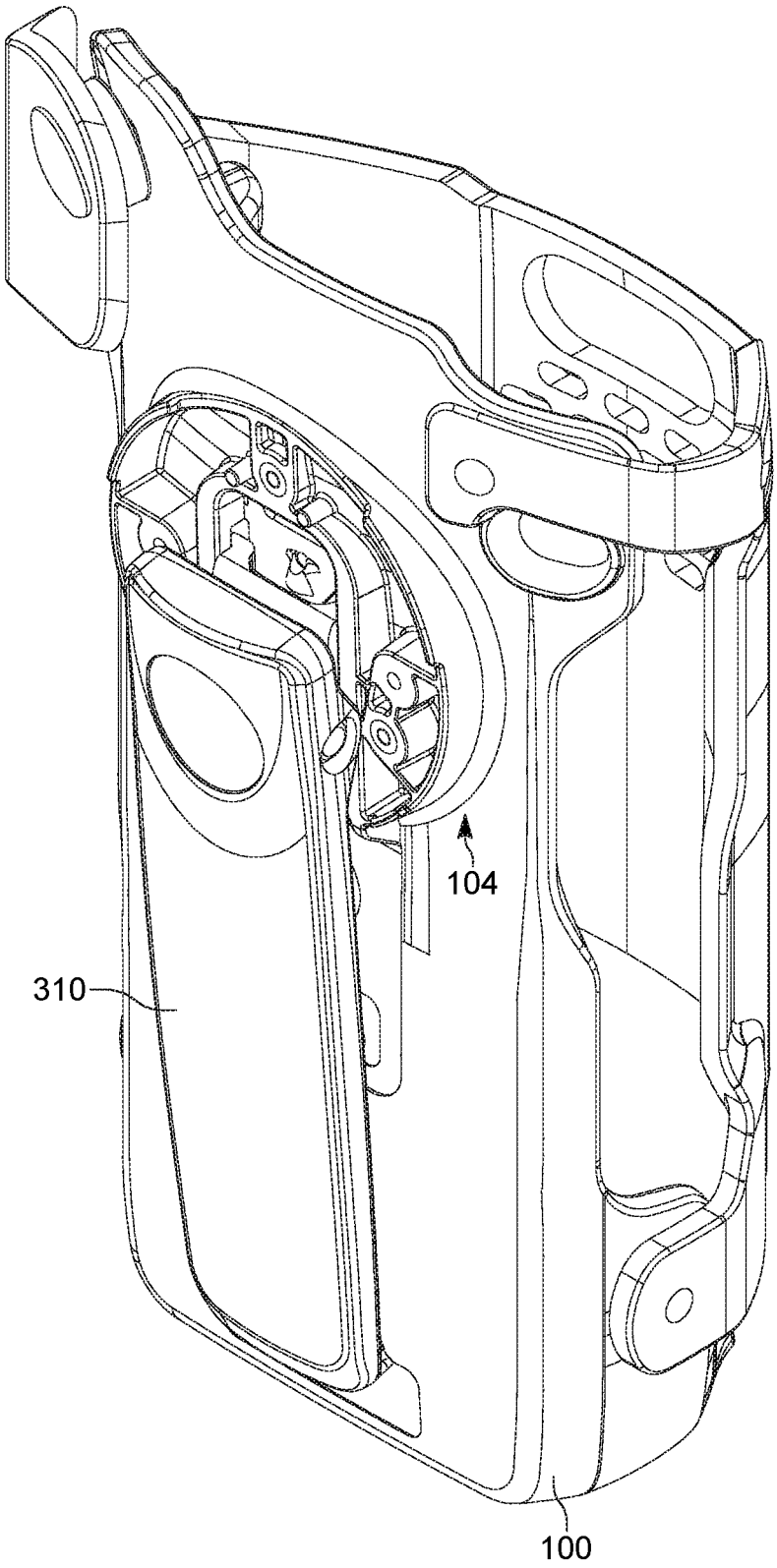
FIG. 3B shows the accessory mount of FIG. 3A coupled to the attachment interface of the holster in accordance with some embodiments.

FIG. 3A shows the attachment interface 104 of the holster 100 with a first mountable accessory in accordance with some embodiments. In this embodiment, the railed track 110 accommodates a belt clip 310. The attachment portion of the belt clip 310 enters within the open end 111*d* of railed track 110 and ramps up ramp 120 where a spring mechanism 302 of the belt clip 310 will engage with locking pin 122. As previously described, the open end 111*d* of the railed track 110 is aligned and merges with the relief opening 112 of the circular retaining wall 106. The belt clip 310 may be removed by inserting a screwdriver tip into release tab 118. FIG. 3B shows the belt clip 310 coupled to the attachment interface 104 of holster 100 in accordance with some embodiments.

Figure 4A:
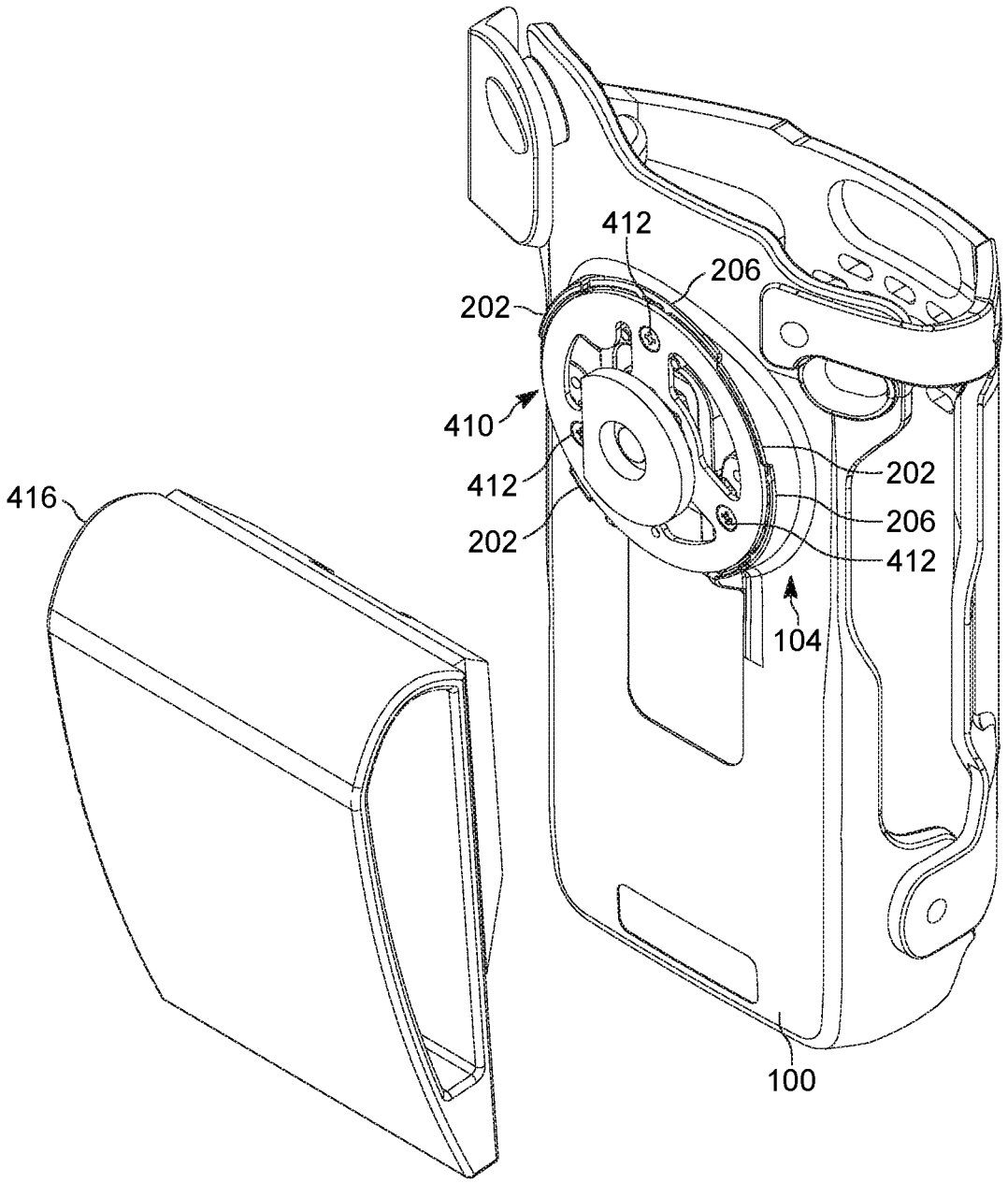
FIG. 4A shows the attachment interface of the holster accepting a two part accessory attachment in accordance with some embodiments.
Figure 4B:
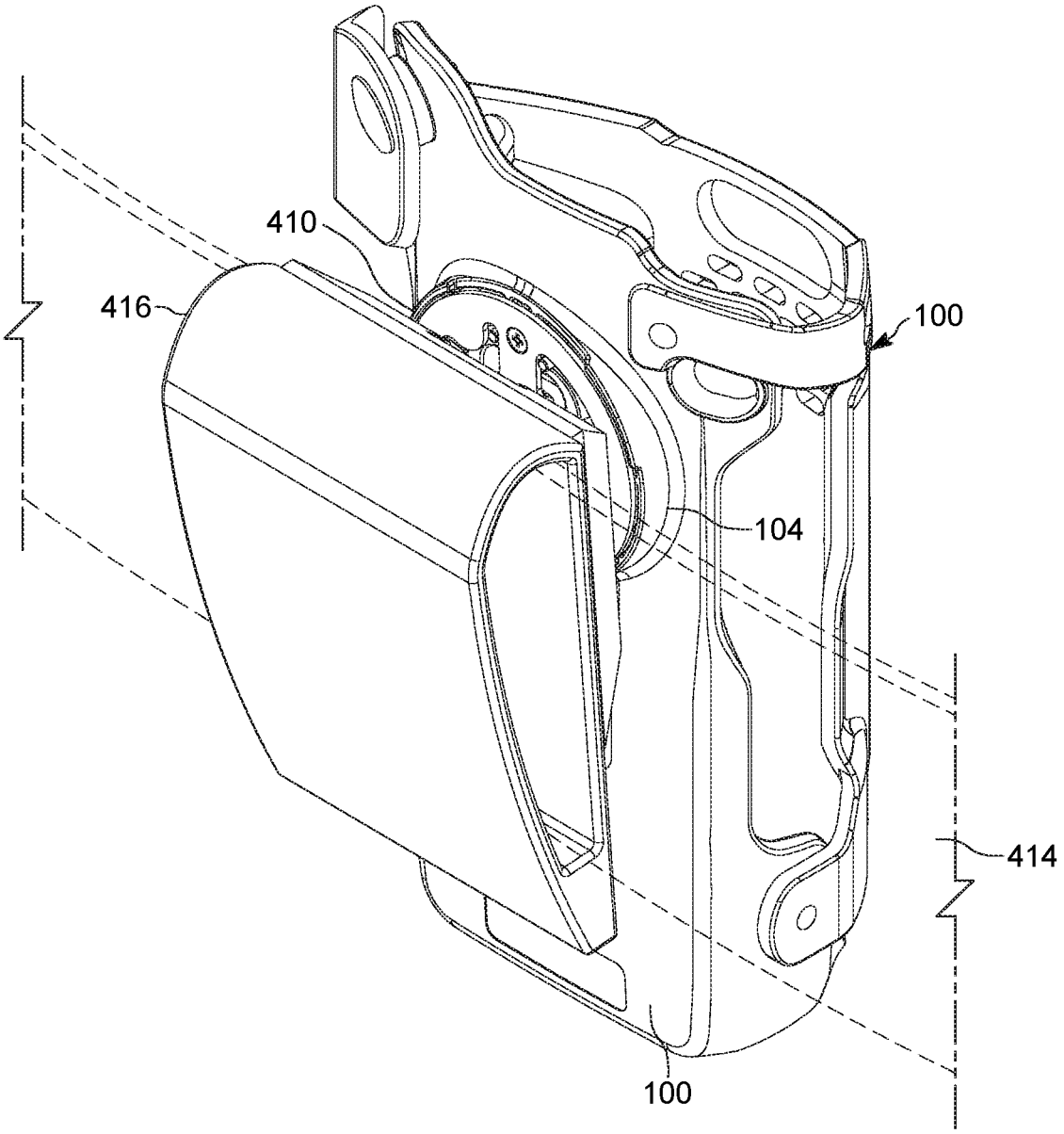
FIG. 4B shows the two-part accessory of FIG. 4A coupled to h attachment interface of the holster in accordance with some embodiments.

FIG. 4A shows the attachment interface 104 of the holster 100 accepting a two part accessory attachment in accordance with some embodiments. In this embodiment, a D-clip circular plate 410 is aligned within the alignment ribs 202 and situated on top of the secondary relief zones 206 of the attachment interface 104 of holster 100. The D-clip circular plate 410 is secured in place with screws 412 mounted into three of the plurality of screw mounts 114 (screw mounts shown in FIGS. 1 and 2). The attachment interface 104 of holster 100 provides rugged and secure retention of the D-clip circular plate 410 to the holster. A corresponding D-loop belt strap 416 can be attached to an article of clothing and the D-clip circular plate 410 can be mounted thereto in a known manner. For example, the corresponding D-loop belt strap 416 can be worn on a user's belt, epaulette or other article clothing. FIG. 4B shows the D-loop belt strap 416 with a belt 414 inserted therethrough (shown in dashed lines). In this view, the D-loop belt strap 416 is coupled to the D-clip circular plate 410 which is screw mounted to attachment interface 104. The combined arrangement provides for a very rugged and secure mounting of the holster 100 to an article of clothing.

Figure 5A:
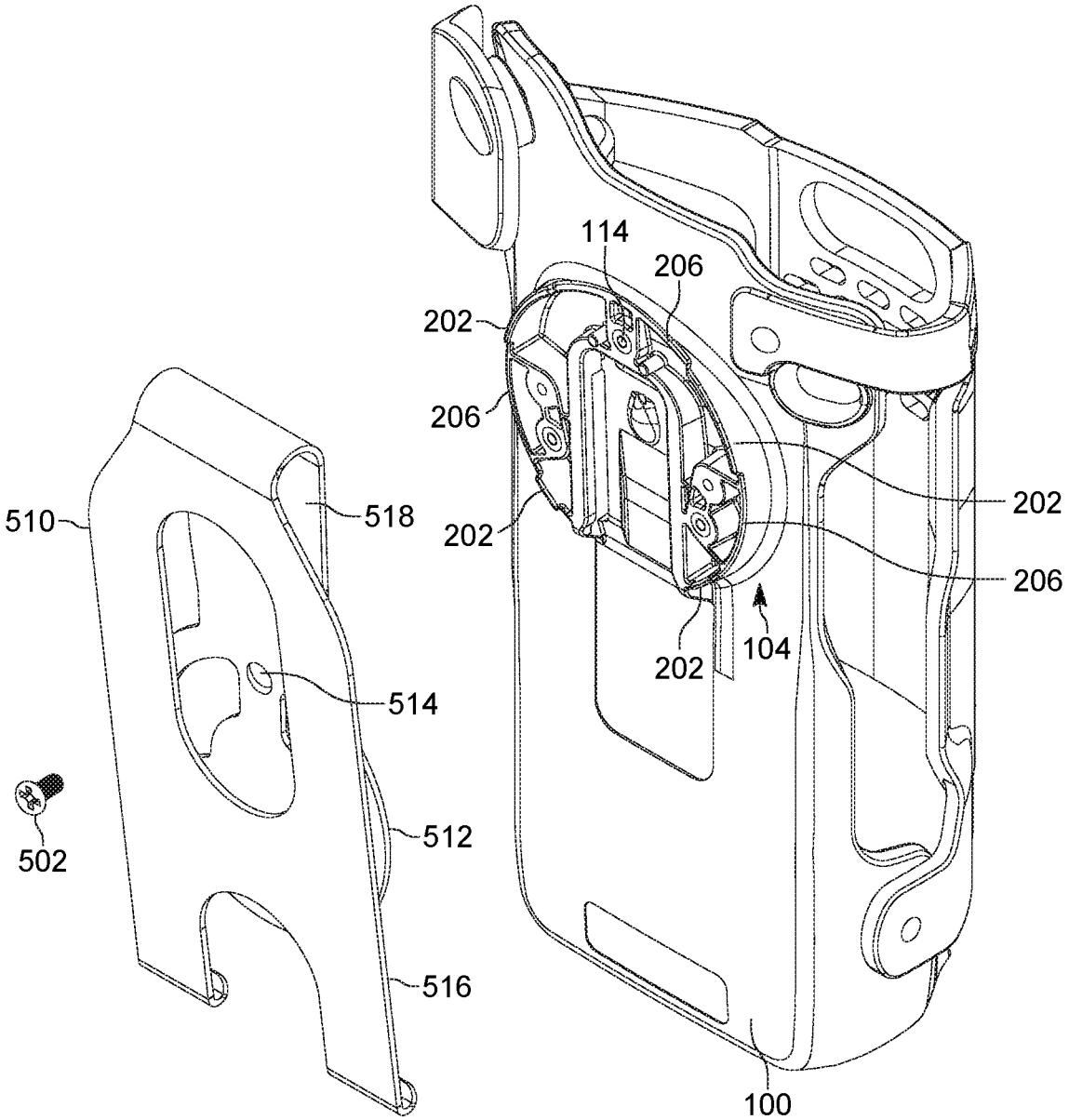
FIG. 5A shows the attachment interface of the holster accepting another accessory attachment in accordance with some embodiments.

FIG. 5A is shows the attachment interface 104 of the holster 100 accepting a third accessory attachment 510. Accessory attachment 510 is formed of a combination circular plate 512 having screw hole 514 formed therein, and a loop 516 having a linear flange 518. The circular plate 512 aligns within alignment ribs 202 of attachment interface 104 for situation upon relief zones 206. The linear flange 518 aligns with a relief zone 206 located at the top of the attachment interface 104 which thereby aligns a top screw mount of the screw mounts 114 with screw hole 514. Accessory attachment 510 is mountable within the alignment ribs 202 and secured to the attachment interface 104 via a single screw 502 insertable through screw hole 514 and into the top screw mount of the plurality of screw mounts 114.

Figure 5B:
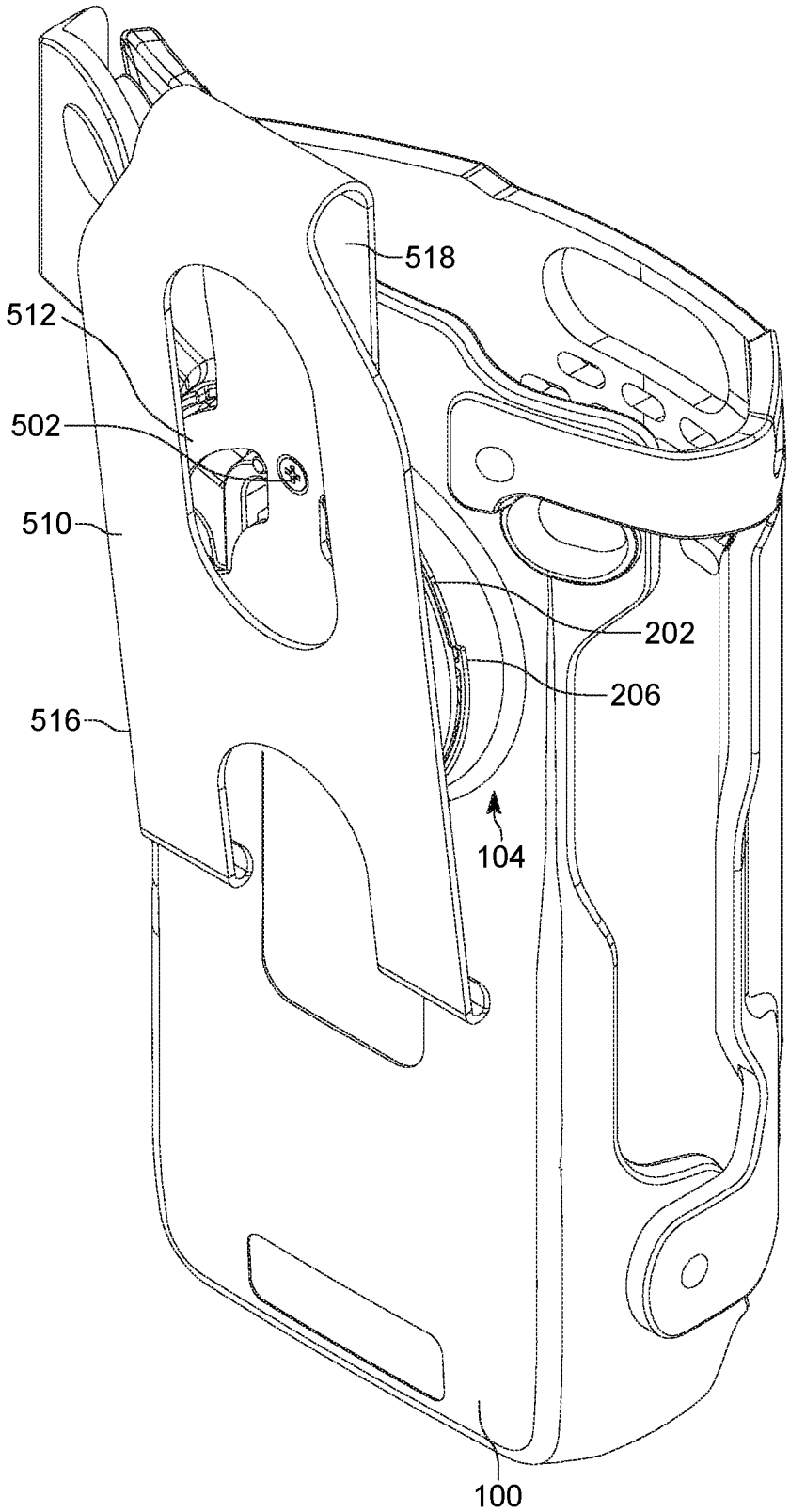
FIG. 5B shows the accessory of FIG. 5A coupled to the attachment interface of the holster in accordance with some embodiments.

FIG. 5B shows the third accessory attachment 510 coupled to the attachment interface 104 of holster 100 in accordance with some embodiments. The circular plate 512 is aligned within alignment ribs 202 and seated upon relief zones 206. The linear flange 518 extends up through the top relief zone of the plurality of relief zones 206 of the attachment interface 104. Accessory attachment 510 is secured to the attachment interface 104 via the single screw 502. Accessory attachment 510 can be worn on a belt, an epaulette or other article of clothing via loop 516.

Accordingly, a variety of accessory mounting attachments can be accommodated by a single holster incorporating the attachment interface 104 as shown and described by the various embodiments. Users can now use the same holster to interchangeably accommodate a plurality of accessory attachments while maintaining a robust form factor for each arrangement.

Figure 6A:
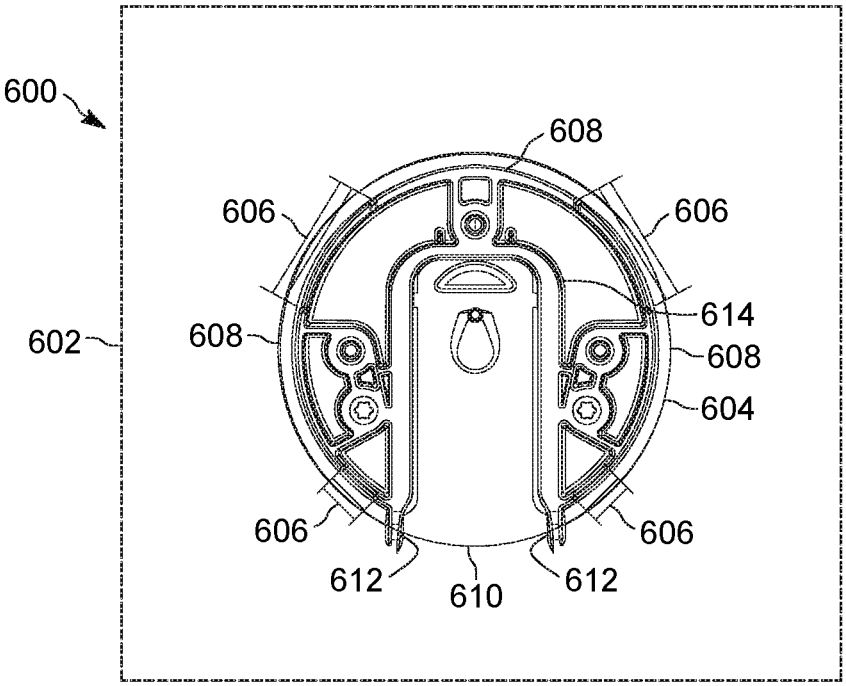
FIG. 6A shows a simplified outline of the attachment interface in accordance with some embodiments.

FIG. 6A shows a simplified outline of the attachment interface in accordance with some embodiments. This view shows attachment interface 600, like attachment interface 104, without the holster, in accordance with some embodiments. The attachment interface 600 may be integrated as part of a rigid substrate 602, such as a hard plastic substrate, forming a unitary piece. The attachment interface 600 comprises a circular retaining wall 604 integrated as part of the substrate 602. The circular retaining wall 604 is formed of a plurality of perimeter alignments ribs 606 extending therefrom with a plurality of relief zones 608, 610 formed therebetween. The plurality of relief zones comprise a primary relief zone 610 and a plurality of secondary relief zones 608. The circular retaining wall 604 forms a partial circle extending around a railed track 614. The primary relief zone 610 merges with an opening 612 of the railed track 614, the railed track being integrated within the circular retaining wall 604 as part of the rigid substrate 602.

Figure 6B:
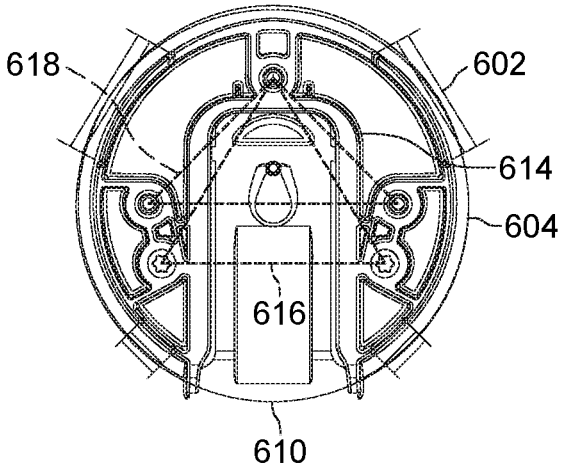
FIG. 6B shows an example of screw mount configurations of the attachment interface in accordance with some embodiments.

FIG. 6B shows some examples of screw mount configurations integrated within the attachment interface 600 in accordance with some embodiments. For example, first and second triangular screw mount configurations 616, 618 are shown. Each triangular configuration 616 or 618 provides for balanced and secure attachment of accessory mounts, when screwed thereon. Fewer or additional screw mounts may be integrated within the attachment interface. In accordance with some embodiments, one or more screw mounts may be located between interior portions of the circular retaining wall 604 and the railed track 614. One or more of the screw mounts can be utilized alone or in combination with the railed track 614 or the circular retaining wall 604 to provide for a plurality of user selectable attachment configurations through the single attachment interface 600.

Accordingly, there has been provided an unproved attachment interface which facilitates mounting a holster to an article of clothing. The consolidation of the interface allows a user to manage the attachment of a variety of different attachment mountings to different articles of clothing improving the user wearable experience.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A holster, comprising:

a housing having an attachment interface, the attachment interface comprising:

a circular retaining wall formed on an exterior surface of the housing, the circular retaining wall having an opening formed along the circular retaining wall;

a railed track formed within the circular retaining wall, the railed track having first and second linear side walls, an open end, and a closed end wall, the open end of the track being aligned and merged with the opening of the retaining wall; and a plurality of screw mounts located between the circular retaining wall and the railed track.

2. The holster of claim 1, wherein the circular retaining wall comprises:

a plurality of perimeter alignment ribs formed as part of and along the circular retaining wall; and a plurality of relief zones formed between the plurality of ribs, the a plurality of relief zones being formed as part of and along the circular retaining wall.

3. The holster of claim 1, wherein the housing comprises a rigid housing portion, and the circular retaining wall, railed track, and plurality of screw mounts are formed and integrated as part of the rigid housing portion.

4. The holster of claim 1, wherein the plurality of screw mounts are located between interior portions of the circular retaining wall and the railed track.

5. The holster of claim 2, wherein the plurality of relief zones of the circular retaining wall comprise a primary relief zone and a plurality of secondary relief zones; and the plurality of screw mounts are located between plurality of secondary relief zones of the circular retaining wall and the railed track.

6. The holster of claim 2, wherein the housing is a two part housing comprising:

a front, non-rigid housing portion; and a back, rigid housing portion, the attachment interface being integrally formed as part of the back rigid housing portion.

7. The holster of claim 1, further comprising:

a ramp formed within the railed track.

8. The holster of claim 1, further comprising:

a locking pin formed within the railed track.

9. The holster of claim 1, further comprising:

a release insert located within the railed track, the release insert configured to accommodate a screwdriver tip.

10. A holster, comprising:

an attachment interface integrally molded as part of a holster housing, the attachment interface comprising:

a railed track having an opening formed therein for receiving a clip; and a circular retaining wall extending around the railed track, the circular retaining wall having a relief opening merged with the opening of the railed track, the circular retaining wall providing a platform for disk mountable attachments at least one screw mount integrated between the railed track and the circular retaining wall.

11. The holster of claim 10, wherein the circular retaining wall comprises:

a plurality of perimeter alignment ribs formed as part of and along the circular retaining wall; and a plurality of relief zones formed between the plurality of ribs, the plurality of relief zones being formed as part of and along the circular retaining wall.

12. The holster of claim 10, wherein the housing comprises a rigid housing portion, and the circular retaining wall, railed track, and at least one screw mount are formed and integrated as part of the rigid housing portion.

13. An attachment interface, comprising:

a rigid substrate having a circular retaining wall integrated therein, the circular retaining wall comprising a plurality of perimeter alignment ribs extending therefrom with forming a plurality of relief zones therebetween on the circular retaining wall; and the plurality of relief zones comprising a primary relief zone and a plurality of secondary relief zones, the primary relief zone merging with an opening of a railed track, the railed track being integrated within the circular retaining wall as part of the rigid substrate.

* * * * *